US010507957B2

(12) United States Patent
Toh et al.

(10) Patent No.: US 10,507,957 B2
(45) Date of Patent: Dec. 17, 2019

(54) FLIP-TOP CAP

(71) Applicant: COLGATE-PALMOLIVE COMPANY, New York, NY (US)

(72) Inventors: Kiat-Cheong Toh, Forest Hills, NY (US); Bruce Cummings, New York, NY (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/511,979

(22) PCT Filed: Sep. 18, 2014

(86) PCT No.: PCT/US2014/056240

§ 371 (c)(1),
(2) Date: Mar. 16, 2017

(87) PCT Pub. No.: WO2016/043745

PCT Pub. Date: Mar. 24, 2016

(65) Prior Publication Data

US 2017/0247152 A1 Aug. 31, 2017

(51) Int. Cl.
*B65D 47/08* (2006.01)
*B65D 41/02* (2006.01)
(Continued)

(52) U.S. Cl.
CPC ..... *B65D 47/08* (2013.01); *B65D 41/02* (2013.01); *B65D 43/16* (2013.01); *B65D 51/18* (2013.01);
(Continued)

(58) Field of Classification Search
CPC ..... B65D 47/08; B65D 41/02; B65D 43/16; B65D 51/18; B65D 2251/0021;
(Continued)

(56) References Cited

U.S. PATENT DOCUMENTS 5,094,361 A * 3/1992 Dubach ..... B65D 47/36 215/235
5,547,091 A * 8/1996 Neveras ..... B65D 35/14 215/237
(Continued)

FOREIGN PATENT DOCUMENTS

EP 0 778 218 6/1997
EP 0778218 A1 * 6/1997 ..... B65D 43/169
WO WO 2010/145720 12/2010

OTHER PUBLICATIONS

International Search Report and the Written Opinion of the International Searching Authority issued in International Application PCT/US2014/056240 dated Apr. 23, 2015.

*Primary Examiner* — David P Angwin
*Assistant Examiner* — Bob Zadeh

(57) ABSTRACT

A cap, apparatus, and method for manufacturing a cap. The cap (104) may include a base (106) defining an orifice therethrough, and a lid ((108) coupled with the base. The lid may include a top surface (125), a bottom surface (134) that is opposite to the top surface, a plug (122) extending from the bottom surface for a first distance, and a brim (114) extending from bottom surface for a second distance that is less than or equal to the first distance. The brim includes a first curve (208) at least partially extending from the bottom surface away from the top surface, and a second curve (210) at least partially extending from the top surface, away from the bottom surface. The brim defines at least a portion of an engagement surface that faces at least partially away from a centerline of the lid. The cap is operable between an open position and a closed position.

20 Claims, 5 Drawing Sheets

(51) Int. Cl.
*B65D 43/16* (2006.01)
*B65D 51/18* (2006.01)

(52) U.S. Cl.
CPC ..... *B65D 2251/0021* (2013.01); *B65D 2251/0078* (2013.01); *B65D 2251/0087* (2013.01)

(58) Field of Classification Search
CPC .... B65D 2251/0078; B65D 2251/0087; B65D 2251/1066
See application file for complete search history.

(56) References Cited

U.S. PATENT DOCUMENTS 5,632,420 A 5/1997 Lohrman et al.
5,782,388 A * 7/1998 De Nervo ..... B65D 47/0838 220/254.3
5,865,353 A * 2/1999 Baudin ..... B65D 47/0814 215/235
5,865,354 A * 2/1999 Bansal ..... B65D 47/0847 215/224
6,257,431 B1 * 7/2001 Baudin ..... B65D 47/0814 215/237
6,401,986 B1 * 6/2002 Randall ..... B65D 47/0804 222/212
6,672,487 B1 1/2004 Lohrman
6,766,926 B1 * 7/2004 Elchert ..... B65D 47/0814 222/498
RE38,816 E * 10/2005 Baudin ..... B65D 47/0814 215/235
7,731,066 B2 6/2010 Norris et al.
7,735,684 B2 6/2010 Coe et al.
D666,493 S 9/2012 Cummings et al.
2007/0145073 A1 * 6/2007 Morini ..... B65D 35/08 222/107
2009/0065528 A1 * 3/2009 Bray ..... B65D 35/44 222/107
2009/0242564 A1 10/2009 Danks et al.
2010/0288787 A1 11/2010 Jaeckel
2017/0247152 A1 * 8/2017 Toh ..... B65D 47/08
2017/0297780 A1 * 10/2017 Cesare ..... B65D 41/34

* cited by examiner

FLIP-TOP CAP

BACKGROUND

Personal hygiene product dispensers, often referred to as bottles or "tottles," may be configured to hold and dispense products such as shampoo and/or conditioner. Such dispensers are available in a variety of shapes and sizes. Generally, the dispensers have a body with a reservoir in which the product is stored, and a sealable cap. One or both of the body and the cap define an orifice that communicates with the reservoir, to allow the product to be dispensed when the cap is open.

The caps may be configured to open and close in different manners. For example, caps may be a single piece that is removable from the body, such as by relative rotation. In another example, the caps may have a base coupled with the body and a lid connected to the base via a hinge. The lid may pivot toward and away from the base, and thus the body, by action of the hinge. In the latter case, a lip is sometimes provided on the lid to facilitate a user applying the requisite pivoting force on the cap.

The caps are generally formed from a molded plastic, and thus generally include a "part line" where two dies were engaged together. Moreover, the part line in a pivoting cap is generally formed at the base of the lid, and generally extends along the lip. Thus, the user's finger may contact the part line while applying the pivoting force. Since the part line typically forms a relatively narrow ridge, contact therewith may be uncomfortable to a user when opening the cap and especially so when die wear and tear results in increased flash at the part line.

BRIEF SUMMARY

Embodiments of the disclosure may provide a cap for a dispenser. The cap may include a base defining an orifice therethrough, and a lid pivotally coupled with the base. The lid may include a top surface, a bottom surface that is opposite to the top surface, a plug extending from the bottom surface for a first distance, and a brim extending from bottom surface for a second distance that is less than or equal to the first distance. The brim includes a first curve at least partially extending from the bottom surface away from the top surface, and a second curve at least partially extending from the top surface, away from the bottom surface. The brim defines at least a portion of an engagement surface that faces at least partially away from a centerline of the lid. The cap is operable between an open position and a closed position. When the cap is in the closed position, the plug is received into the orifice, and when the cap is in the open position, the orifice is exposed.

Embodiments of the disclosure may also provide an apparatus for dispensing a product. The apparatus may include a hollow body to contain the product therein and comprising one or more corners. The apparatus may also include a cap. The cap may include a base forming an interference fit with the hollow body and defining an orifice. The base includes one or more corners positioned to mate with the one or more corners of the hollow body, and a lid pivotally coupled with the base and including a top surface, a bottom surface that is opposite to the top surface, and a brim including a first curve extending from the bottom surface, away from the top surface, and a second curve extending from the top surface, away from the bottom surface, wherein the brim defines at least a portion of an engagement surface that faces at least partially away from a centerline of the lid, the lid further comprising one or more corners positioned to mate with the one or more corners of the base. The cap is operable between an open position and a closed position. When the cap is in the closed position, the lid covers the orifice, and when the cap is in the open position, the lid is pivoted away from the orifice.

Embodiments of the disclosure may also provide a method for manufacturing a cap. The method includes injecting a plastic into a mold to form the cap. The cap includes a base defining an orifice therethrough, and a lid pivotally coupled with the base and including a top surface, a bottom surface that is opposite to the top surface, a plug extending from the bottom surface by a first distance, and a brim. The brim includes a first curve extending from the bottom surface, away from the top surface, and a second curve extending from the top surface, away from the bottom surface, wherein the brim defines at least a portion of an engagement surface that faces at least partially away from a centerline of the lid. The brim extends from the bottom surface for a second distance that is less than or equal to the first distance. Further, the cap is operable between an open position and a closed position. When the cap is in the closed position, the plug is received into the orifice, and when the cap is in the open position, the orifice is exposed. The method may also include waiting for the plastic in the mold to at least partially solidify, and removing the cap from the mold.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
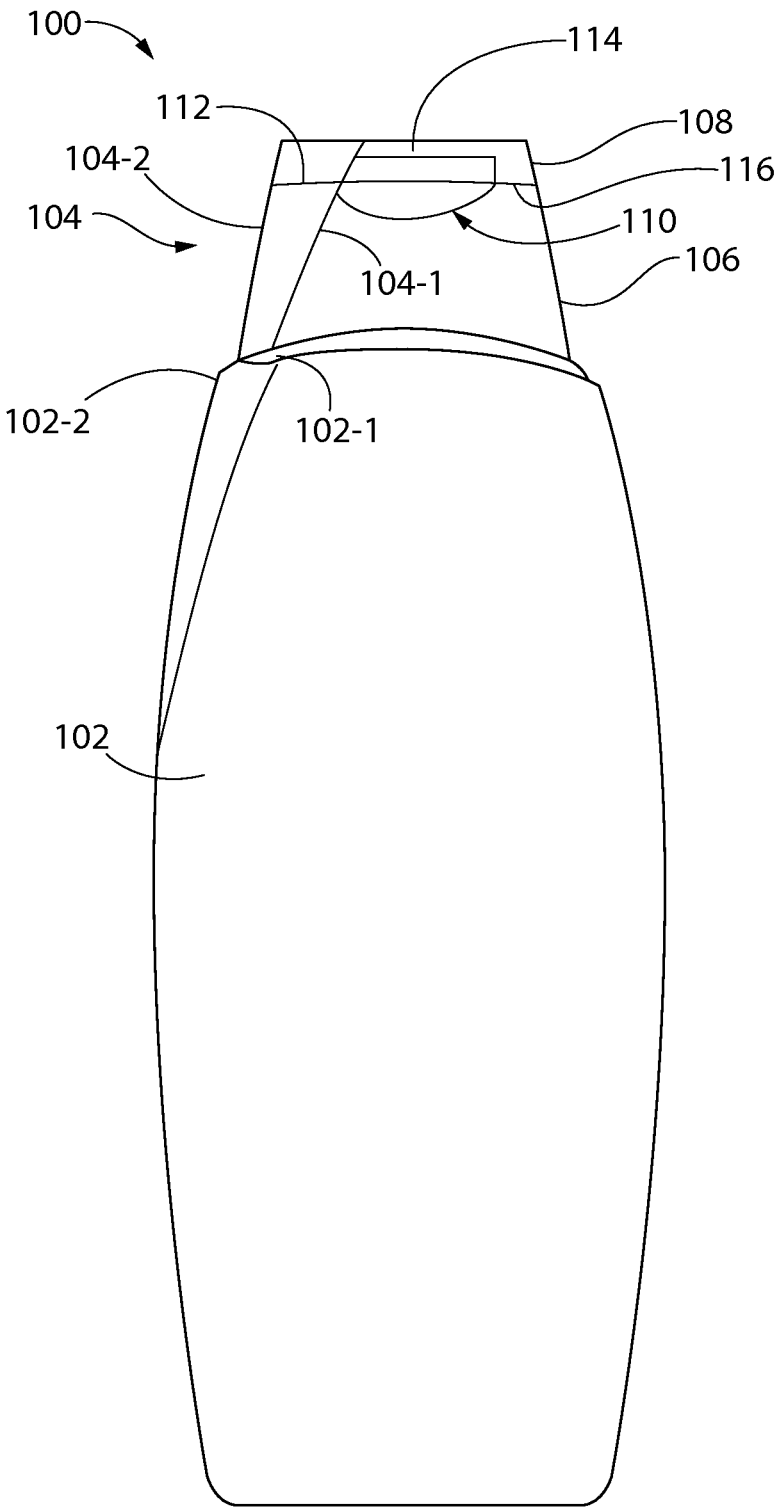
FIG. 1 illustrates a side view of a dispenser, according to an embodiment.

FIG. 1 illustrates a side view of a dispenser 100, according to an embodiment. In some embodiments, the dispenser 100 may be configured to contain and facilitate dispensing of personal hygiene products, such as shampoo, conditioner, etc. In other embodiments, the dispenser 100 may be configured for use with any other type of product of any viscosity or density, whether liquid, gas, paste, gel, granular solid, combinations thereof, or the like.

The dispenser 100 may generally include a body 102 and a cap 104. The body 102 may have any shape. In the illustrated embodiment, which is merely one example among many contemplated, the body 102 has a generally ovular shape, as viewed in a cross-section perpendicular to the illustrated side view (e.g., looking down on the body 102). In some instances, the oval shape may project a perception of a larger volume, e.g., as compared to a cylindrical body 102. However, in some cases, the efficiency of a cylindrical body 102 may be advantageously employed. The body 102 may define a reservoir therein, as well as an orifice (e.g., an open end, spout, etc.) that allows communication with the reservoir. For example, the body 102 may be a generally hollow, thin-walled structure, such that the reservoir defined therein forms at least a majority of the total volume occupied by the body 102.

The cap 104 may be coupled with the body 102, for example, via meshing threads, snap fit, interference fit, interlocking members, etc., so as to seal the reservoir when the cap 104 is in the closed position (as illustrated). The cap 104 may include a base 106, which is coupled with the body 102, and a lid 108 that is coupled with the base 106. As will be described in greater detail below, a hinge may be provided (e.g., integrally-formed with the base 106 and the lid 108), allowing the lid 108 to be pivoted relative to the base 106.

Additionally, the body 102 may include one or more corners (two are visible: 102-1 and 102-2) and the cap 104 may includes corners 104-1, 104-2. The corners 104-1, 104-2 may be received over the corners 102-1, 102-2. In embodiments in which the cap 104 is snapped onto the body 102 (e.g., held onto the body 102 by mechanical interference therebetween), the mating engagement between the corners 102-1, 102-2 and 104-1, 104-2 may provide an anti-rotation feature of the dispenser 100, at least partially preventing rotation between the cap 104 and the body 102. As the term is used herein, "corner" may refer to an intersection between two surfaces. A corner does not necessarily have to come to a point, but may be rounded.

Further, the base 106 may include a recess 110, proximal to a top 112 thereof, e.g., adjacent to the lid 108. The recess 110 may have at least a partially curved shape, which may be configured to smoothly engage a finger of a user. The recess 110 may not be symmetric, however, and may be abruptly or smoothly tapered to a greater degree on one end than on another for a variety of reasons, such as, e.g., aesthetics. Moreover, the recess 110 may be defined generally opposite to the pivotal connection (e.g., the hinge) between the lid 108 and the base 106.

The lid 108, in turn, may include a brim 114, which may overhang the recess 110. The brim 114 may be smoothly formed, e.g., curved consistently with the recess 110, so as to form a generally smooth surface for engagement with a user's finger. In an embodiment, the brim 114 may be free from part lines formed thereon. A "part line" generally refers to a thin, ridge-like protrusion formed in a molded structure, where two dies come together and are separated after the structure is molded. For example, the brim 114 may be formed such that the part line, formed at a lower edge 116 of the lid 108, is between the brim 114 and the base 106. Accordingly, in some embodiments, the brim 114 may be considered to be "above" the part line.

In a specific embodiment, the part line follows the lower edge 116 around a majority of the lid 108, and climbs from the lower edge 116 to between the second portion 130 and the brim 114, when reaching the brim 114. Continuing around the lid 108, the part line then descends back to the lower edge 116 at the other circumferential end of the brim 114.

To the extent that a user's finger may engage the part line, due to the smooth brim 114 and the location of the part line, the part line may be disposed at an angle to the user's finger, such that a sharp edge of the part line does not bite into a user's finger. Further, the second portion 130 may provide an increased surface area in comparison to other lid designs, which may distribute the pressure of the user's finger when engaging the brim 114 to open the lid 108.

Figure 2:
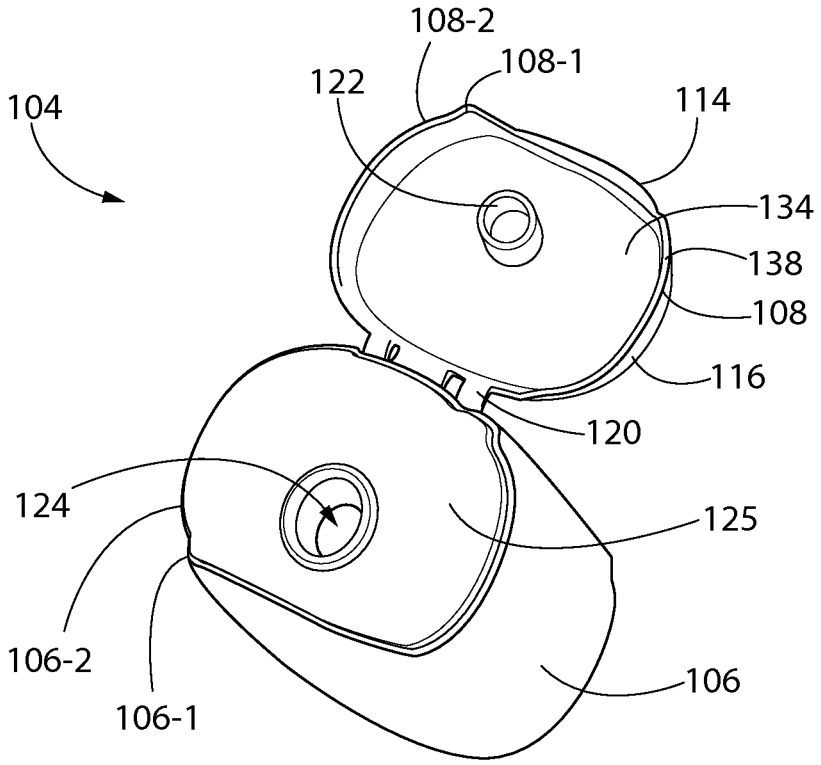
FIG. 2 illustrates a perspective view of a cap in an open position, according to an embodiment.
Figure 3:
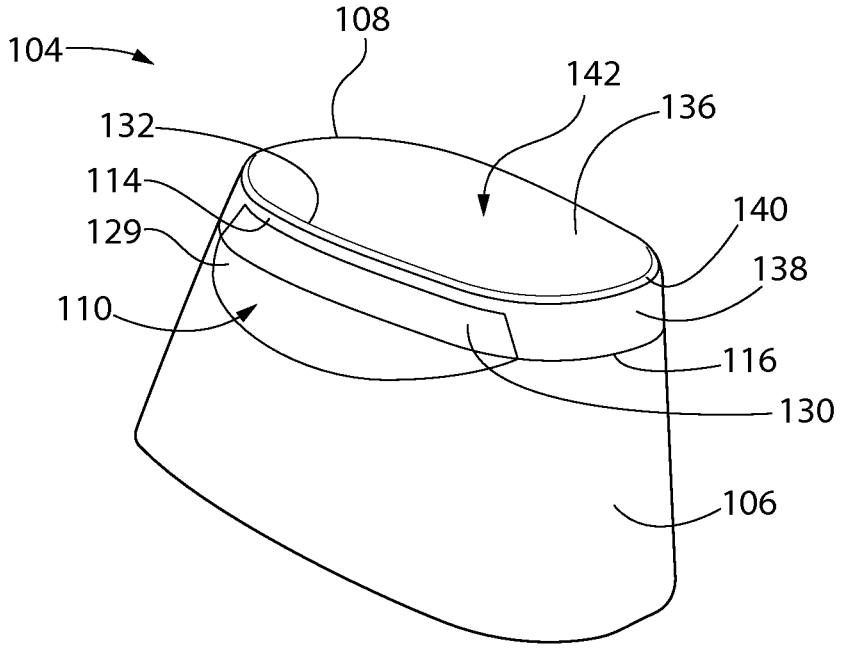
FIG. 3 illustrates a perspective view of the cap of FIG. 2 in a closed position, according to an embodiment.

The cap 104 may be operable between open and closed positions. For example, FIG. 2 illustrates a perspective view of the cap 104 in an open position, according to an embodiment. FIG. 3 illustrates a perspective view of the cap 104 in a closed position, according to an embodiment. As shown, the lid 108 may be coupled with the base 106 via a hinge 120. The hinge 120 may be integral with (e.g., unitary and/or formed from the same piece as) one or both of the lid 108 and the base 106. Further, the hinge 120 may be formed as a plurality of articulating and/or bendable segments that together allow for pivoting motion of the lid 108 with respect to the base 106. In other embodiments, separate hinges or other types of integral hinges may be employed, without limitation. Whether integrally-formed or formed separately and later attached to one or both of the lid 108 and base 106, the hinge 120 may be referred to as "coupled" to or with the lid 108 and/or base 106, such that the lid 108 and the base 106 are pivotably coupled together.

The lid 108 may also include a plug 122, and the base 106 may define an orifice 124 therein. The orifice 124 may be defined as an open-ended recess extending downward from a top surface 125 of the base 106. Moreover, the orifice 124 may be configured to communicate with the reservoir of the body 102 (FIG. 1) when attached to the body 102. Further, the plug 122 may be configured to fit into and/or around the orifice 124, e.g., to generally seal or at least substantially obstruct the orifice 124. Accordingly, when the cap 104 is in the closed position (FIG. 3), the plug 122 may prevent the contents of the reservoir of the body 102 from egress via the orifice 124. When the cap 104 is in the open position (FIG. 2), on the other hand, the lid 108 (and thus the plug 122) may be moved away from the orifice 124, such that the orifice 124 is exposed. In the open position, the contents of the reservoir of the body 102 may be dispensed via the orifice 124. With the lid 108 being pivotally attached to the base 106 via the hinge 120, the movement of the cap 104 from the closed position to the open position, and from the open position to the closed position, may be effected by pivoting the lid 108 with respect to the base 106.

In an embodiment, when the cap 104 is in the closed position (FIG. 3), the brim 114 of the lid 108 may cooperate with the recess 110 of the base 106 to form an outwardly-facing (e.g., away from the center of the cap 104) engagement surface 129 configured to smoothly receive a user's finger, e.g., across the bottom edge 116 of the lid 108. Accordingly, a portion of the engagement surface 129 may be provided by the curved recess 110, as discussed above, while a second portion 130 of the engagement surface 129 may be provided by the lid 108, e.g., between the bottom edge 116 and the apex 132 of the outer rim 140 at the brim 114.

The lid 108 may also define a bottom surface 134 (visible in FIG. 2) and a top surface 136 (visible in FIG. 3), which are generally opposite to one another. A sidewall 138 may extend between the top and bottom surfaces 134, 136, and may extend from the bottom surface 134, away from the top surface 136. The sidewall 138 may provide the connection point with the hinge 120. Moreover, at least a portion of the sidewall 138 may provide the brim 114.

The bottom surface 134 may generally face the base 106, at least when the cap 104 is in the closed position. Accordingly, in at least some embodiments, the bottom surface 134 may be generally planar. The top surface 136, e.g., facing away from the base 106 when the cap 104 is in the closed position, may define an outer rim 140. The outer rim 140 may generally be defined in a single plane. In at least one embodiment, the outer rim 140 may be generally oval-track-shaped, e.g., formed generally as two parallel lines connected at either end by two semi-circles. In some cases, the outer rim 140 may deviate from a strict oval-track shape, such as where protrusions or cut-outs are formed, while still being elongated and generally formed as a track, and thus may still be considered "substantially oval-track-shaped."

The top surface 136 may define a depression 142, proceeding inwards from the outer rim 140, e.g., from one point on the outer rim 140 towards a diametrically-opposed, second point thereon. The depression 142 may be provided so as to reduce a thickness of the brim 114, as will be described in greater detail below. Moreover, the depression 142 may perform this function while allowing the dispenser 100 (FIG. 1) to be stable when inverted, e.g., with the cap 104 supporting the weight of the dispenser 100 against a support surface (e.g., the ground, a counter-top, a table, etc.). In one specific embodiment, the top surface 136, defining the depression 142, may be generally concave, as shown, but in others, the top surface 136 may be generally planar inward from the outer rim 140.

As can also be appreciated from FIG. 2, the base 106 may include one or more corners 106-1, 106-2, and the lid 108 may include one or more corresponding corners 108-1, 108-2. The corners 106-1, 106-2, 108-1, 108-2 may together provide the corners 104-1, 104-2 shown in and described above with reference to FIG. 1. The corners 108-1, 108-2 of the lid 108 may overlap and engage the corners 106-1, 106-2 of the base 106, when the lid 108 is in the closed position. This may further prevent rotation therebetween, in addition to preventing rotation between the cap 104 and the body 102.

Figure 4:
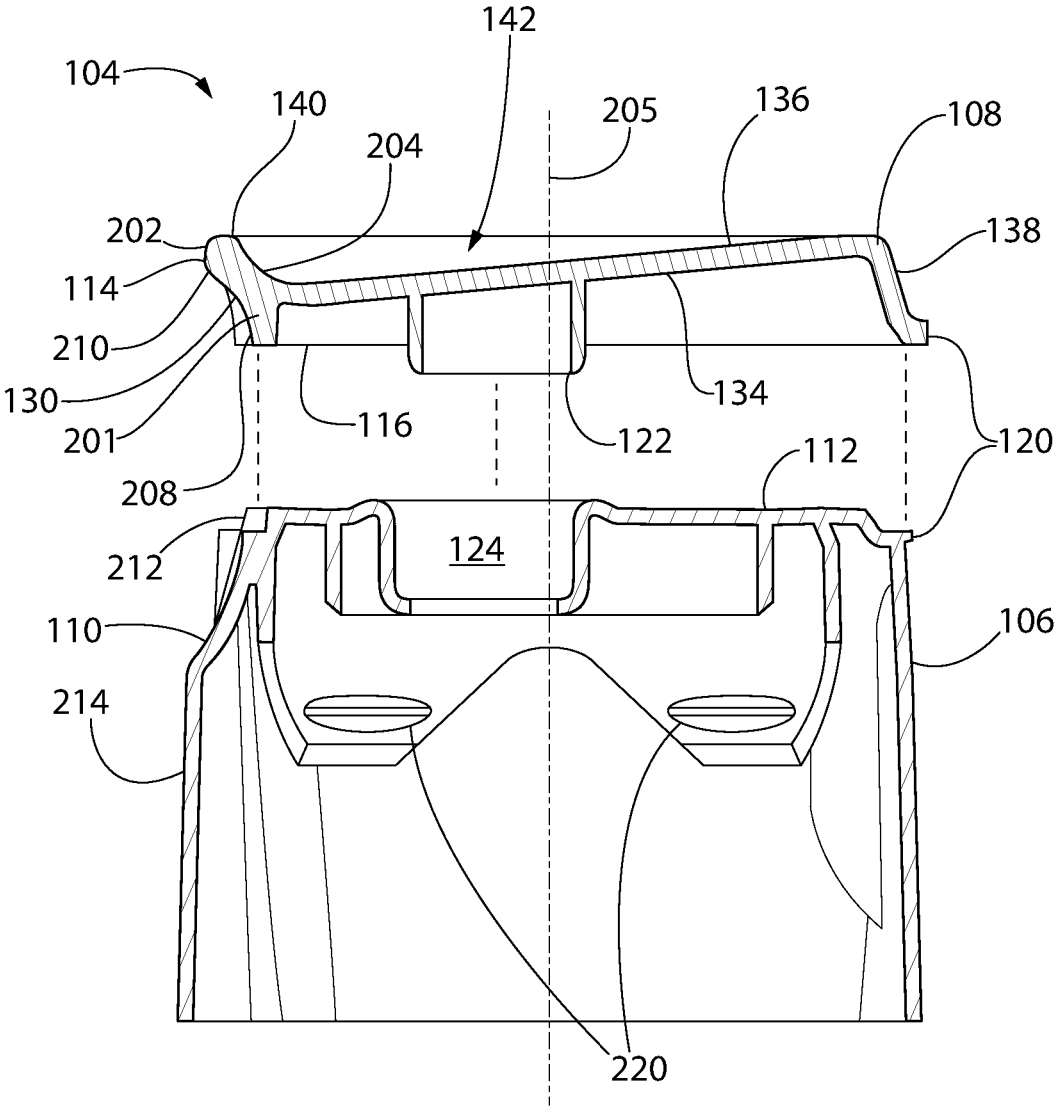
FIG. 4 illustrates a side, cross-sectional, exploded view of the cap, according to an embodiment.

FIG. 4 illustrates a side, cross-sectional, exploded view of the cap 104, according to an embodiment. It will be appreciated that the lid 108 may be pivotably coupled with the base 106 via the hinge 120 (the hinge 120 is shown broken apart, for purposes of illustrating the alignment of the lid 108 and base 106). It will thus be appreciated that the illustrated exploded view is merely for purposes of describing the embodiment of the cap 104 and may not be illustrative of a normal operating configuration of the cap 104.

The plug 122, as shown, extends for a first distance downward, from the bottom surface 134. The brim 114, in comparison, extends for a second distance downward from the bottom surface, with the first distance being greater than or equal to the second distance.

Further, in an embodiment, the brim 114 includes a skirt 201, which may extend from the bottom surface 134, away from the top surface 136. In an embodiment, the skirt 201 may terminate at the lower edge 116 of the lid 108, such that the lower edge 116 is generally planar, as shown. Moreover, the lower edge 116 of the lid 108 may be where the part line is located. Accordingly, the brim 114 may be defined "above" the part line. The brim 114 may also extend from the top surface 136, away from the bottom surface 134, toward the outer rim 140.

The brim 114 may further include a front side 202 and a back side 204, which may face in opposite directions. For example, the front side 202 may face away from a centerline 205 of the lid 108, and may be partially provided by the skirt 201. Moreover, the front side 202 may form the portion 130 of the outwardly-facing engagement surface 129 (see FIG. 3). In an embodiment, the front side 202 may include one or more curves, e.g., a first or lower curve 208 and a second or upper curve 210. The back side 204 may also be curved, and may join the top surface 136 at a radiused junction (e.g., fillet), so as to smoothly transition therebetween. Further, a portion of the outer rim 140 may connect the front side 202 and the backside 204. As shown, the lower curve 208 may curve outward, generally oblique or perpendicular to the centerline 205, while the upper curve 210 may curve back toward parallel to the centerline 205.

As shown, the top surface 136 may be generally planar, and may be inclined relative to the centerline 205 (e.g., intersect the centerline 205 at a non-perpendicular angle). Moreover, the bottom surface 134 may be similarly inclined, thus providing a generally uniform thickness for the lid 108. The outer rim 140 may, however, be defined in a plane that is perpendicular to the centerline 105; as such, the top surface 136 may be inclined relative to the outer rim 140. Thus, the vertical (e.g., parallel to the centerline 205) distance from the top (e.g., the apex 132, FIG. 3) of the outer rim 140 to the top surface 136 may vary as extending around the outer rim 140. In an example, the distance may reach a maximum at a point along the brim 114.

The brim 114 extending from the top surface 136 may maintain the generally uniform thickness of the lid 108 at the brim 114, although the thickness may increase by a relatively small amount. This may mitigate the lid 108 shrinking or otherwise deforming during the formation process, which could otherwise occur if the lid 108 were substantially thicker proximal to the brim 114.

The base 106 may also include one or more connectors 220. The connectors 220 may be sized and/or otherwise configured to receive the top of the hollow body 102 (FIG. 1), and may form a non-threaded engagement therewith. For example, the connectors 220 may snap onto the body 102, e.g., forming a mechanical interference fit therewith.

The lower edge 116, including the skirt 201, may be sized to be received into a stepped shoulder 212 of the base 106, at least when the cap 104 is in the closed position. The stepped shoulder 212 may define an intermediate surface between a sidewall 214 of the base 106 and the top 112 thereof. For example, the lower edge 116 may be the same size as or slightly smaller than the dimension of the stepped shoulder 212, and may thus form an interference fit therewith, which may retain the engagement between the lid 108 and the base 106. Moreover, it will be appreciated that the plug 122 may be received in the orifice 124 when the lid 108 is pivoted such that the cap 104 is in the closed position.

When the cap 104 is in the closed position, the recess 110 may align with the front side 202 of the brim 114. In particular, the lower curve 208, which may be at least partially defined by the skirt 201, above the part line, may be aligned with the recess 110. This may provide a smooth transition between the base 106 and the lid 108 at the recess 110. Moreover, the stepped shoulder 212 may receive the part line formed on the lower edge 116, such that the part line is not part of the engagement surface defined by the brim 114, the recess 110, or both.

Figure 5:
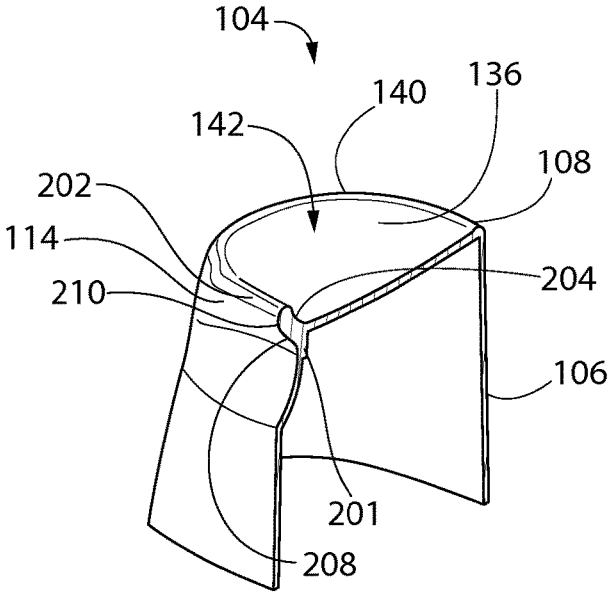
FIGS. 5-7 illustrate simplified, cross-sectional views of three embodiments of the cap.
Figure 6:
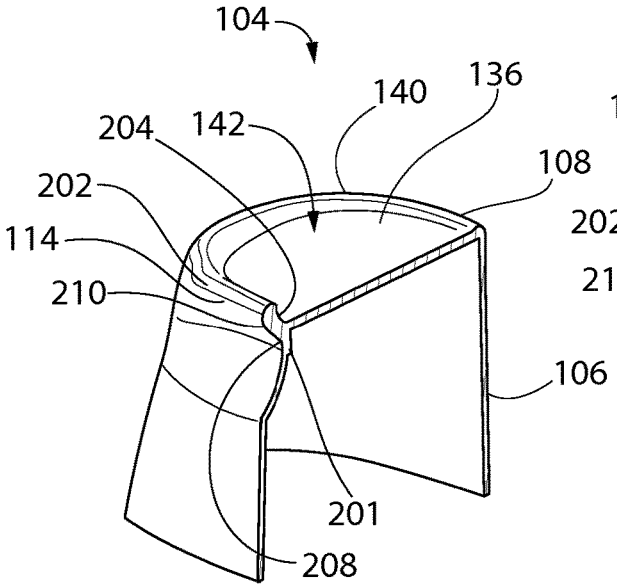
Figure 7:
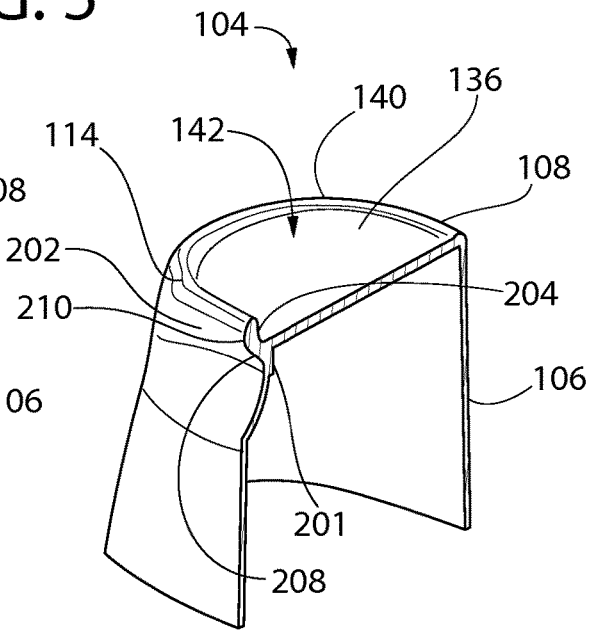

FIGS. 5-7 illustrate simplified sectional views of three embodiments of the cap 104. FIGS. 5-7 are provided to illustrate a few embodiments of the brim 114, and thus the interaction between the bottom surface 134 and the base 106 is omitted; similarly, the hinge 120 is omitted for simplicity of description. It will be appreciated that the three illustrated embodiments are provided herein for illustrative purposes and are not to be considered an exhaustive listing of examples; rather, they are three examples among many contemplated. As discussed above, the cap 104 generally includes the base 106 and the lid 108, which may be pivotably connected together.

Further, the lid 108 includes the top surface 136, sidewall 138, outer rim 140, and depression 142. As can be appreciated from FIGS. 5-7, the depression 142 may be non-symmetric about the centerline 205 of the cap 104. For example, the depression 142 may become deeper (e.g., the vertical distance between the top surface 136 and the outer rim 140 may increase) as proceeding toward the brim 114. In a specific embodiment, the brim 114 may be located at or near the deepest portion of the depression 142. Accordingly, the provision of the depression 142 may allow the brim 114 to have a relatively small cross-sectional thickness, rather than extending as a solid wall across the lid 108.

With additional reference to FIG. 4, FIGS. 5-7 illustrate that the brim 114 may define one or more of several different shapes. For example, the portion of the sidewall 138 at the brim 114 may include the skirt 201, which may extend downwards from the bottom surface 134, e.g., by a lesser distance than the sidewall 138 extends at points away from the brim 114. In particular, in at least one embodiment, the lower edge 116 of the sidewall 138 may be substantially planar. Thus, the reduced extension of the skirt 201 may account for the inclination (or asymmetrical depth) of the top surface 136.

As shown in FIG. 5, the front side 202 may have the flattened-S shape defined by the curves 208, 210. For example, the lower curve 208 may be at least partially defined at the skirt 201, while the upper curve 210 may be at least partially defined above the top surface 136. The back side 204 may extend upwards from the top surface 136 and may be aligned with the upper curve 210. In an embodiment, the back side 204 may generally have the same, or a similar, curved profile as the upper curve 210 of the front side 202. The outer rim 140 may extend from the back side 204 and the front side 206 in a semi-circular arc (or another shape). Further, the depression 142 may be relatively shallow, except proximal to the central area of the brim 114.

As shown in FIG. 6, the front side 202 may again define the lazy-S shape having the lower and upper curves 208, 210, and the back side 204 may be curved and aligned with the upper curve 210. However, the top surface 136 may be generally planar and inclined relative to the centerline 205, thereby defining a generally planar ramp. The top surface 136 may meet the back side 204 at a filleted junction, but may otherwise be substantially flat.

As shown in FIG. 7, the back side 204 may be generally planar, in addition to the top surface 136 being planar. However, in other embodiments, the back side 204 may be planar while the top surface 136 is generally concave. In an embodiment, the back side 204 may be substantially parallel to the centerline 205, although, again, the connection between the back side 204 and the top surface 136 may be filleted, as shown. The embodiment of FIG. 7 may be similar to the embodiment of FIG. 5, except that the depression 142 may not be localized to the area proximal to the center area of the brim 114, but may extend more evenly across the width of the cap.

Figure 8:
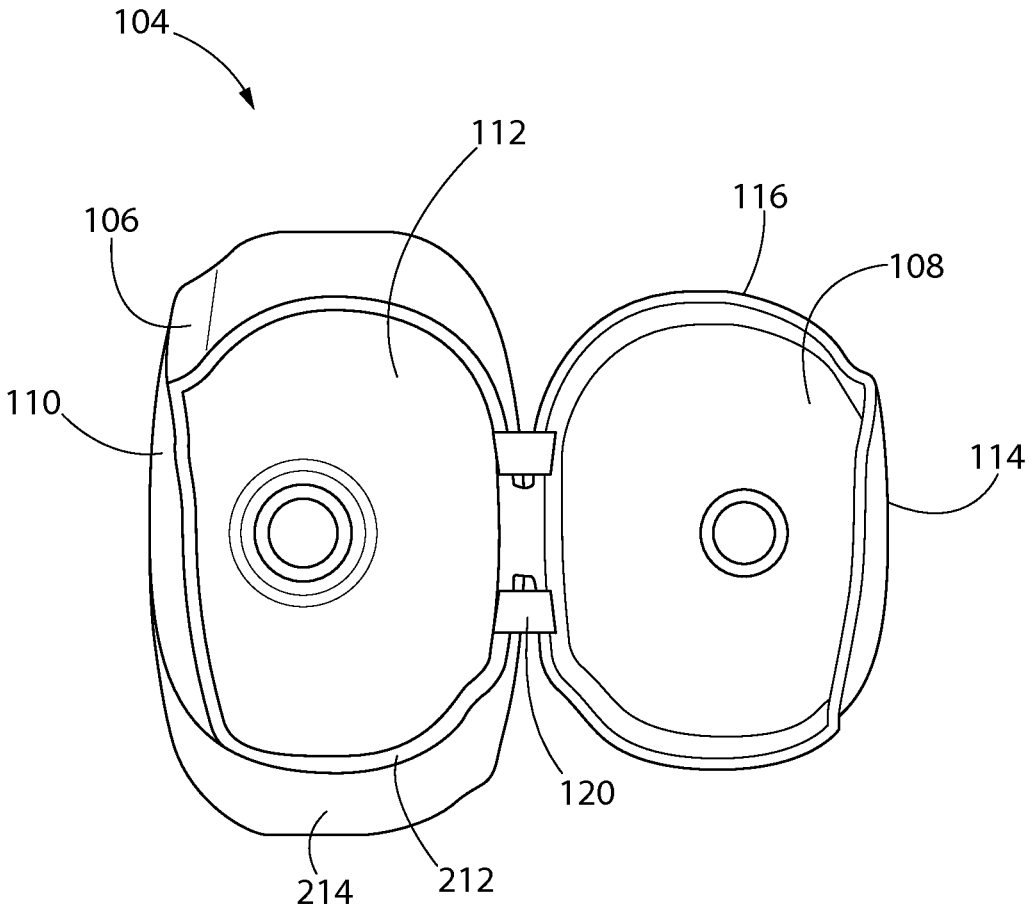
FIG. 8 illustrates a top, plan view of the cap in an open position, according to an embodiment.

FIG. 8 illustrates a top plan view of the cap 104 in the open position, according to an embodiment. As shown, the base 106 defines a substantially oval-track shape. A strict oval-track shape may, however, be deviated from by provision of the recess 110, as shown, as well as other features, without departing from the definition of "substantially oval-track-shaped." Further, the sidewall 214 of the base 106, in which the recess 110 is defined, may form the stepped shoulder 212 where the sidewall 214 meets the top 112 of the base 106, e.g., proximal to the periphery of the base 106. The stepped shoulder 212 may be sized and positioned to receive the lower edge 116 of the lid 108, so as to provide a stable connection therewith. In addition, as can be appreciated from this view, the sidewall 214 may expand in size as proceeding away from the top 112, which may facilitate connection with the body 102 of the dispenser 100 (FIG. 1).

Embodiments of the disclosure may also provide a method for manufacturing a cap, such as one or more embodiments of the cap 104 discussed above. Accordingly, a molten plastic may be injected into a mold (e.g., a cavity formed between two or more dies). The mold may provide the desired shape and structure of the cap 104. The injected plastic may be allowed to at least partially solidify, e.g., by waiting for a time. The cap, made from the plastic, may then be removed from the mold, e.g., by separating the dies.

The directional terms provided above are used merely for convenience when referring to the illustrated example orientations and are not meant to require or imply any fixed reference plane. In particular, descriptions such as "up" "upward," "above," "upper," "top," "down," "downward," "below," "bottom," "inward," "outward" and grammatical equivalents thereof are merely intended to refer to the relative positioning of the structures that are described, as shown in the Figures.

What is claimed is:

1. A cap for a dispenser, comprising:

a base defining an orifice therethrough; and a lid coupled with the base, the lid comprising:

a top surface;

a bottom surface that is opposite to the top surface;

a plug extending from the bottom surface for a first distance; and a brim extending from the bottom surface for a second distance that is less than or equal to the first distance, the brim including a first curve at least partially extending from the bottom surface away from the top surface, and a second curve at least partially extending from the top surface, away from the bottom surface, wherein the brim defines at least a portion of an engagement surface that faces at least partially away from a centerline of the lid, wherein the cap is operable between an open position and a closed position, and wherein:

when the cap is in the closed position, the plug is received into the orifice; and when the cap is in the open position, the orifice is exposed;

wherein the first curve, as proceeding toward the second curve, curves away from parallel to the centerline, and the second curve, as proceeding away from the first curve, curves toward parallel to the centerline; and wherein the lid comprises a depression extending from an apex of an outer rim to at least the centerline, wherein the outer rim extends from a back side of the lid to a front side of the lid in a semi-circular arc.

2. The cap of claim 1, wherein the brim comprises:

a brim front side providing the at least a portion of the engagement surface; and a brim back side facing the centerline.

3. The cap of claim 2, wherein the first and second curves are defined on the brim front side.

4. The cap of claim 2, wherein the brim back side is substantially flat.

5. The cap of claim 1, wherein the brim comprises a skirt extending from the bottom surface and away from the top surface, the skirt defining at least a portion of the first curve.

6. The cap of claim 1, wherein the outer rim provides at least a portion of the brim, wherein the top surface is concave such that a distance, in a direction parallel to the centerline, is defined between the apex of the outer rim and the top surface.

7. The cap of claim 6, wherein the distance is non-zero, varies around the outer rim, and is at a maximum at a point along the brim.

8. The cap of claim 1, wherein the outer rim provides at least a portion of the brim, and wherein the top surface is inclined relative to a plane defined by the outer rim, such that a distance, in a direction parallel to the centerline, from the apex of the outer rim and the top surface is at a maximum at a point along the brim.

9. The cap of claim 1, wherein the base comprises a recess that is at least partially aligned with the brim when the cap is in the closed position, and wherein the recess provides at least a second portion of the engagement surface.

10. The cap of claim 9, wherein a sidewall of the base and a top of the base form a stepped shoulder proximal to a periphery of the base, wherein the stepped shoulder receives an edge of the lid when the cap is in the closed position, and wherein the recess is defined in the sidewall.

11. The cap of claim 1, wherein the depression is non-symmetric about the centerline.

12. An apparatus for dispensing a product, comprising:

a hollow body to contain the product therein and comprising one or more corners; and a cap comprising:

a base forming an interference fit with the hollow body and defining an orifice, the base comprising one or more corners positioned to mate with the one or more corners of the hollow body; and a lid pivotally coupled with the base and comprising a top surface, a bottom surface that is opposite to the top surface, and a brim including a first curve extending from the bottom surface, away from the top surface, and a second curve extending from the top surface, away from the bottom surface, wherein the brim defines at least a portion of an engagement surface that faces at least partially away from a centerline of the lid, the lid further comprising one or more corners positioned to mate with the one or more corners of the base, and wherein the first curve, as proceeding toward the second curve, curves away from parallel to the centerline, and the second curve, as proceeding away from the first curve, curves toward parallel to the centerline, wherein the cap is operable between an open position and a closed position, and wherein:

when the cap is in the closed position, the lid covers the orifice;

when the cap is in the open position, the lid is pivoted away from the orifice; and wherein the lid comprises a depression extending from an apex of an outer rim to at least the centerline, wherein the outer rim extends from a back side of the lid to a front side of the lid in a semi-circular arc.

13. The apparatus of claim 12, wherein the brim comprises:

a brim front side, at least a portion of the brim front side providing the at least a portion of the engagement surface, and a brim back side facing the centerline.

14. The apparatus of claim 12, wherein the brim comprises a skirt extending from the bottom surface and away from the top surface, the skirt providing at least a portion of the first curve.

15. The apparatus of claim 14, wherein the skirt is received into a stepped shoulder of the base when the cap is in the closed position.

16. The apparatus of claim 12, wherein the outer rim provides at least a portion of the brim, wherein the apex of the outer rim is spaced apart from the top surface by a distance, parallel to the centerline, that varies as proceeding along the outer rim, wherein the distance is at a maximum at a point along the brim.

17. The apparatus of claim 12, wherein the outer rim provides at least a portion of the brim, and wherein the top surface is inclined relative to a plane defined by the outer rim, such that a distance, parallel to the centerline, from the apex of the outer rim and the top surface is at a maximum at a point along the brim.

18. The apparatus of claim 12, wherein the base comprises a recess that is at least partially aligned with the brim when the cap is in the closed position.

19. The apparatus of claim 18, wherein the recess provides a second portion of the engagement surface and, when the cap is in the closed position, the recess is aligned with the brim.

20. The apparatus of claim 12, wherein the depression is non-symmetric about the centerline.

* * * * *